US005354344A

United States Patent [19]

Takizawa et al.

[11] Patent Number: 5,354,344

[45] Date of Patent: Oct. 11, 1994

[54] GASOLINE FUEL COMPOSITION CONTAINING 3-BUTYN-2-ONE

[75] Inventors: Haruo Takizawa, Tochigi; Akihiro Shimizu, Saitama; Shigehisa Yamada, Saitama; Hiromichi Ikebe, Saitama; Hiroaki Hara, Saitama, all of Japan

[73] Assignees: Cosmo Research Institute; Cosmo Oil Co., Ltd., both of Tokyo, Japan

[21] Appl. No.: 921,695

[22] Filed: Jul. 30, 1992

[30] Foreign Application Priority Data

Aug. 1, 1991 [JP] Japan ..... 3-215868

[51] Int. Cl.[5] ..... C10L 1/18

[52] U.S. Cl. ..... 44/439; 44/350; 44/437; 44/444; 44/448

[58] Field of Search ..... 44/350, 351, 437, 439, 44/444, 448

[56] References Cited

U.S. PATENT DOCUMENTS

| | | | |
|---|---|---|---|
| 1,582,420 | 1/1926 | Nikaido | 44/444 |
| 2,107,069 | 2/1938 | Evan | 44/448 |
| 2,143,870 | 1/1939 | Ellis | 44/444 |
| 2,178,403 | 10/1939 | Muskrat . | |
| 2,210,942 | 8/1940 | Lipkin . | |
| 2,262,466 | 11/1941 | Orelup | 44/352 |
| 2,321,311 | 6/1943 | Mottlau et al. | 44/352 |
| 2,827,494 | 3/1958 | Brown et al. | 44/444 |
| 2,842,432 | 7/1958 | Newman et al. | 44/444 |
| 2,893,952 | 7/1959 | Chenicek | 44/437 |
| 3,782,911 | 1/1974 | Hoffman | 44/352 |
| 3,909,216 | 9/1975 | Stearns et al. | 44/352 |
| 4,191,536 | 3/1980 | Niebylski | 44/352 |
| 4,328,004 | 5/1982 | Globus | 44/412 |
| 4,390,345 | 6/1983 | Somorjai | 44/352 |
| 4,539,015 | 9/1985 | Tedeschi et al. | 44/436 |
| 4,844,717 | 7/1989 | Croudace et al. | 44/437 |

FOREIGN PATENT DOCUMENTS

| | | |
|---|---|---|
| 0082689 | 6/1983 | European Pat. Off. . |
| 842947 | 6/1939 | France . |
| 545464 | 5/1942 | United Kingdom . |

*Primary Examiner*—Margaret Medley
*Attorney, Agent, or Firm*—Sughrue, Mion, Zinn, Macpeak & Seas

[57] ABSTRACT

A fuel oil composition for use in a spark ignition engine, which comprises conventional gasoline for spark ignition engine use and a compound selected from the group consisting of an alkynyl alcohol, alkynyl ether, alkynyl ketone, alkenyl aldehyde or an acetal thereof, furan or a furan compound, and an alkenyl ether. The gasoline composition for fuel use renders possible improvement of flame propagation speed over a broad range of fuel/air ratios, easy optimization of the ignition timing of a spark ignition engine, improvement of engine output power independently of operation conditions, improvement of ignitability without using metal components when a spark ignition engine is operated with a lean or rich fuel-air mixture, and reduction of cycle fluctuation caused by the variation in the formation of fuel-air mixture which occurs even at the time of normal operation, thereby repressing fluctuations in indicated mean effective pressure, maximum cylinder pressure and the like independently of changes in the fuel/air ratio.

2 Claims, 4 Drawing Sheets

① He-Ne laser
② Half mirror
③ Mirror
④ Combustion vessel
⑤ Ignition plug
⑥ Pressure transducer
⑦ Photodiode
⑧ Amplifier
⑨ Trigger
⑩ Ignition equipment
⑪ Oscilloscope
⑫ Personal computer ① He-Ne laser
② Half mirror
③ Mirror
④ Combustion vessel
⑤ Ignition plug
⑥ Pressure transducer
⑦ Photodiode
⑧ Amplifier
⑨ Trigger
⑩ Ignition equipment
⑪ Oscilloscope
⑫ Personal computer

GASOLINE FUEL COMPOSITION CONTAINING 3-BUTYN-2-ONE

FIELD OF THE INVENTION

This invention relates to a fuel oil composition, which comprises gasoline for use as a main component in a spark ignition engine, and at least one specified oxygen-containing compound. More particularly, it relates to a fuel oil composition which comprises gasoline for spark ignition engine use, and an oxygen-containing organic compound that contains both a triple bond or a double bond and an oxygen atom in one molecule.

BACKGROUND OF THE INVENTION

Flame propagation speeds of conventional gasolines suitable for use in spark ignition engines have been measured by various means under various conditions. When a fuel/air ratio in a spark ignition engine is close to the stoichiometric ratio, it is necessary to maintain maximum pressure at the time of combustion at a level lower than the intrinsic maximum pressure to avoid surface ignition, self ignition or the like. Because of this, the time of ignition is spark-advanced from top dead center. In this instance, the term "spark advance" is used to express a crank angle at the time of ignition in advance of the compression top dead center, whose crank angle is defined as 0°. For example, an expression "10° spark advance of ignition" means ignition at 10° crank angle in advance of the compression top dead center. Such an ignition spark advance, however, causes an increase in the combustion pressure during the compression stroke, which results in power loss and reduction of thermal efficiency. In addition, when the fuel/air ratio is too small or too large, the flame propagation speed becomes low, the power decreases sharply and the ignitability becomes poor, thus causing an increase in cycle fluctuation (which means burning fluctuation of each cycle, cyclic variation in combustion duration, maximum pressure or etc. which evaluated as standard deviations). As a consequence, the flame propagation speed and ignitability of conventional gasoline cannot solve such problems of power loss and cycle fluctuation.

In the theoretical cycle of a spark ignition engine (Otto cycle), it is considered in general that the maximum power is obtained when the flame propagation speed of the fuel/air mixture reaches infinity, and the ignition is effected at the top dead center of the compression stroke, followed by instant completion of combustion. Accordingly, it is desirable to use a gasoline fuel which has a higher flame propagation speed than that of conventional gasoline, so that the spark advance can be reduced and ignition can be effected at a crank angle close to the top dead center.

Burning velocity and inflammability limit are physicochemical constant of each compound. These values at atmospheric temperature and pressure have been measured in accordance with the NACA (National Advisory Committee for Aeronautics) method, and the like, revealing the existence of oxygen-containing organic compounds which have high burning velocity and broad inflammability ranges. These data, however, have been obtained from a safety engineering point of view, with no discussion about these oxygen-containing organic compounds with regard to their flame propagation speeds, ignitabilities and the like in a spark ignition engine.

Recently, a constant-volume combustion apparatus has been developed for use in the evaluation of combustion properties of liquid fuel oil (Japanese Patent Application No. 3-1550954, which is hereby incorporated by reference), together with experimental techniques for simple comparative measurement of flame propagation speed and ignitability of liquid fuel at desired fuel/air ratio under certain conditions.

This combustion apparatus comprises a combustion chamber as the main body, equipped with two observation windows on opposite sides. The inside of the main body includes a closed combustion chamber, a heater attached to the outer wall of the combustion vessel, a thermocouple for use in the detection of temperature in the combustion chamber, a liquid fuel oil feeder as a means to supply the combustion chamber with a desired volume of liquid fuel oil, an air supply means to supply the combustion chamber with air, an agitator achieving homogeneous mixtures movable in the combustion chamber, and a spark plug which can discharge a spark in the combustion chamber. Using this combustion apparatus, flame propagation speed can be measured through the observation window, making use of a laser beam refraction method or the like, and combustion characteristics of liquid fuel oil can be evaluated at a laboratory level.

The laser beam refraction method means as follows. A Herium-Neon laser light was split into three beams which passed through the combustion chamber and were detected by high-sensitivity photodiodes. As a flame front which had a high density gradient arrived at an individual beam, the bean was deflected from its course by refraction. Then the laser light reaching each photodiode decreased. The signals from all of the photodiodes were monitored by a digital oscilloscope. The period from ignition to the time of the flame front arriving at the each beam was measured.

FIG. 4 is a whole view of the constant-volume combustion apparatus and FIG. 5 is a partial enlarged view of the combustion vessel.

It is known that, when a fuel-air mixture consisting of air and a multi-component fuel such as gasoline is subjected to combustion in a combustion chamber, variation in the formation of the fuel-air mixture and differences in the ignitability in each cycle become important factors with regard to the aforementioned cycle fluctuation in a spark ignition engine. As a consequence, it would be advantageous if certain fuel additives and fuel blends were available which minimized fluctuation of combustion conditions in each cycle and stabilized combustion. These additives must be effective even under conditions when variation in the formation of the fuel-air mixture and differences in ignitability occur, such as when the fuel/air ratio is too small or too large, or during constant speed driving.

The ignitability is evaluated by the period of ignition lag or the formation of a misfire, which is measured, for example, by the time of from ignition to 10% mass burning rate, and when a misfire is occurred, this time is zero.

With regard to additives useful for the improvement of ignitability of a lean fuel-air mixture, JP-A-62-1785 corresponding to U.S. Pat. No. 4,765,800 (the term "JP-A" as used herein means an "unexamined published Japanese patent application) discloses that ignitability can be improved by the use of, for example, alkali metal salts or alkaline earth metal salts of succinic acid derivatives, which improve ignition lag by shortening flame traveling time from the spark plug gap to the 10 mm distant laser beam without contaminating the inside of the engine. However, metal moieties contained in these compounds are discharged together with exhaust gas, and the discharged metal moieties not only accumulate in the exhaust system but also are discharged further into the air, thus requiring an environmental countermeasure. Also, it is known that these discharged metal moieties degrade the activity of catalysts which are present in the exhaust gas treatment system. In addition, only ignitability is evaluated in the cited '785 patent application, with no disussion of flame propagation speed.

SUMMARY OF THE INVENTION

It is an object of the present invention to provide a fuel oil composition for use in a spark ignition engine, which has superior ignitability and higher flame propagation speed compared to conventional gasoline.

Another object of the present invention is to provide a fuel oil composition for use in a spark ignition engine, which renders possible stable combustion and improved power without discharging metal moieties.

Other objects and advantages of the present invention will be made apparent as the description progresses.

To achieve the above objects and in accordance with the present invention, there is provided a fuel oil composition for use in a spark ignition engine, which comprises gasoline for spark ignition engine use and an oxygen-containing organic compound. The oxygen-containing organic compound contains either a triple bond or a double bond, and an oxygen atom in one molecule.

Thus, the present invention is achieved by blending conventional gasoline for spark ignition engine use with a specified oxygen-containing organic compound.

DETAILED DESCRIPTION OF THE INVENTION

Figure 1:
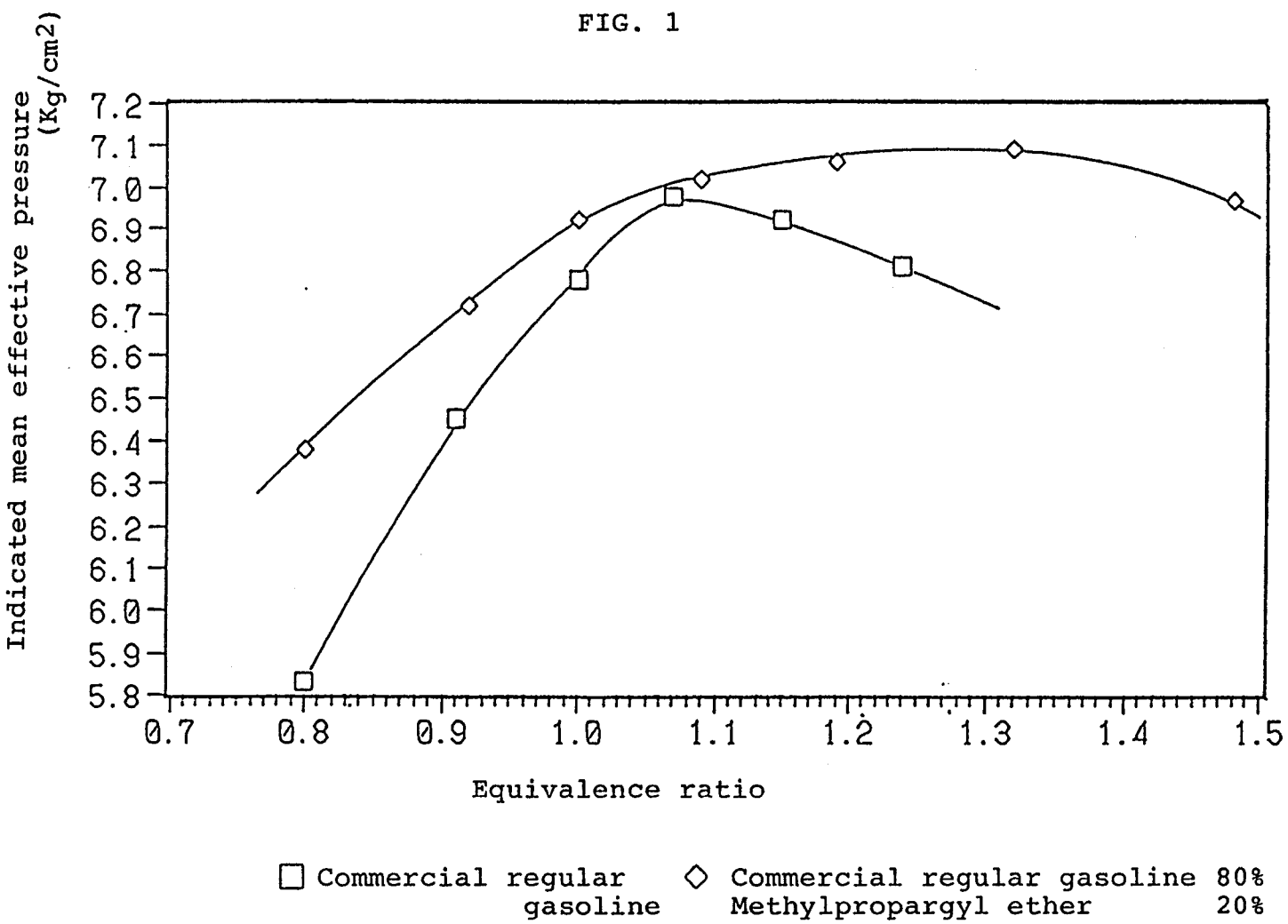
FIG. 1 is a graph showing indicated mean effective pressure at each equivalence ratio, with regard to a commercial regular gasoline and a gasoline preparation used in Example 2.

According to a first aspect of the present invention, there is provided a fuel oil composition for use in a spark ignition engine, which comprises gasoline for spark ignition engine use and an alkynyl alcohol or an alkynyl ether represented by the following general formula:

$$R_1-C\equiv C-R_2-O-R_3 \qquad (I)$$

wherein each of $R_1$ and $R_3$, which may be the same or different, is a hydrogen atom or a straight- or branched-chain alkyl group having 1 to 3 carbon atoms and $R_2$ is a straight- or branched-chain divalent hydrocarbon radical having 1 to 6 carbon atoms.

According to a second aspect of the present invention, there is provided a fuel oil composition for use in a spark ignition engine, which comprises gasoline for spark ignition engine use and an alkynyl ketone represented by the following general formula:

$$R_4-C\equiv C-CO-R_5 \qquad (II)$$

wherein $R_4$ is a hydrogen atom or a straight- or branched-chain alkyl group having 1 to 3 carbon atoms and $R_5$ is a straight- or branched-chain alkyl group having 1 to 3 carbon atoms.

According to a third aspect of the present invention, there is provided a fuel oil composition for use in a spark ignition engine, which comprises gasoline for spark ignition engine use and an alkenyl aldehyde represented by the following general formula:

$$R_6-\underset{R_7}{\underset{|}{C}}=\underset{R_8}{\underset{|}{C}}-CHO \qquad (III)$$

wherein each of $R_6$, $R_7$ and $R_8$, which may be the same or different, is a hydrogen atom or a straight- or branched-chain alkyl group having 1 to 3 carbon atoms; or an acetal resulting from treatment of the aldehyde group of the alkenyl aldehyde of formula (III) with an alcohol.

According to a fourth aspect of the present invention, there is provided a fuel oil composition for use in a spark ignition engine, which comprises gasoline for spark ignition engine use and furan or a furan compound represented by the following general formula:

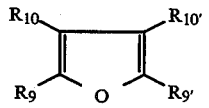

(IV)

wherein each of $R_9$, $R_{9'}$, $R_{10}$ and $R_{10'}$, which may be the same or different, is a hydrogen atom, a straight- or branched-chain alkyl group having 1 to 3 carbon atoms or a CHO group, provided that the compound does not contain two or more CHO groups at the same time.

According to a fifth aspect of the present invention, there is provided a fuel oil composition for use in a spark ignition engine, which comprises gasoline for spark ignition engine use and an alkenyl ether represented by the following general formula:

$$R_{11}-\underset{R_{12}}{\underset{|}{C}}=\underset{R_{14}}{\underset{|}{C}}-R_{13}-O-R_{15}-\underset{R_{16}}{\underset{|}{C}}=\underset{R_{18}}{\underset{|}{C}}-R_{17} \qquad (V)$$

wherein each of $R_{11}$, $R_{12}$, $R_{14}$, $R_{16}$, $R_{17}$ and $R_{18}$, which may be the same or different, is a hydrogen atom or a straight- or branched-chain alkyl group having 1 to 3 carbon atoms, and each of $R_{13}$ and $R_{15}$, which may be the same or different, is a straight- or branched-chain divalent hydrocarbon radical having 1 to 3 carbon atoms.

Illustrative examples of the straight- or branched-chain divalent hydrocarbon radical as substituents $R_{13}$ and $R_{15}$ include methylene, alkylene and alkylidene.

The "oxygen-containing organic compound" used herein thus preferably is a specified acyclic oxygen-containing compound having at least one triple bond or double bond together with an oxygen atom in one molecule, the oxygen atom preferably being attached to a carbon atom adjacent to the triple or double bond, or is furan or a furan compound, which can improve ignitability and increase flame propagation speed when added to gasoline.

The oxygen-containing organic compound to be used in the present invention preferably has a boiling point of from about 30° to about 230° C., which is within the range of generally used gasoline, and contains straight- or branched-chain alkyl groups preferably having around 3 to 10 carbon atoms in total.

The oxygen-containing organic compounds to be used in the present invention are compounds in which an oxygen atom is attached to a carbon atom adjacent to a triple bond or a double bond in one molecule. Illustrative examples of the compounds represented by the aforementioned general formula (I) include propargyl alcohol, 3-butyn-2-ol, 3-butyn-1-ol, 3-methyl-1-pentyne-3-ol, and methylpropargyl ether. An example of compounds represented by the general formula (II) includes 3-butyn-2-one. A preferred amount of 3-butyn-2-one is 10% by volume based on the volume of the gasoline. Examples of compounds of the general formula (III) include acrolein, metacrolein, and tiglic aldehyde. An example of an acetal is acrolein dimethyl acetal, which is obtained by methanol-treatment of the aldehyde group of the corresponding alkenyl adlehyde. Example of compounds of the formula (IV) include furan, 2-methylfuran, and furfural. An example of compounds of the formula (V) includes diallyl ether.

The use of an oxygen-containing compound having a smaller number of carbon atoms may be effective for the purpose of increasing the flame propagation speed. For example, in the case of alkynyl alcohols, the use of propargyl alcohol is most preferable to obtain such an effect. However, since propargyl alcohol itself has poor solubility with gasoline, it is most preferable to use methylpropargyl ether, which has high solubility with gasoline, and is obtained by subjecting propargyl alcohol to methyletherification.

The oxygen-containing organic compound may be added to gasoline prepared from gasoline base materials which will be described later, preferably in an approximate amount of from 0.05 to 50% by volume based on the volume of said gasoline for the purpose of improving combustion characteristics. Especially, it may be used preferably in an approximate amount of from 5 to 50% by volume based on the volume of said gasoline for the purpose of considerably improving output (performance) characteristics. Also, it may preferably be used generally in an approximate amount of from 0.05 to 40% by volume based on the volume of said gasoline, to provide easy handling when a fuel oil composition having similar properties to those of conventional gasoline is prepared.

In the oxygen-containing organic compound to be used in the present invention, properties of its oxygen substituent become an important factor in determining solubility of the compound in gasoline. To improve solubility in gasoline, it is desirable to use a compound having an ether linkage (including furan and furan compounds). When the oxygen substituent is a hydroxyl group, solubility of a triple bond hydrocarbon radical in gasoline increases as the number of carbon atoms increases. However, when effects on the distillation conditions of gasoline are taken into consideration, it is preferable to use a compound having 3 to 6 carbon atoms. In addition, when the compound of interest has poor solubility in gasoline, a small amount of, for example, tertiary butyl alcohol may be added as a solubility improving agent.

The oxygen-containing organic compounds represented by the aforementioned general formulae (I) to (V) to be contained in gasoline may be used alone, or, as optionally a mixture thereof.

The gasoline to be supplied with the oxygen-containing organic compound may have such properties that it can be used suitably in a spark ignition engine, with its main component being a mixture of hydrocarbons having an approximate boiling point of from 30° to 230° C. Such a type of gasoline may optionally contain unsaturated hydrocarbons and aromatic hydrocarbons, and it may be prepared at well depending on its use in, for example, general traveling, racing or the like. For example, as a fuel for general traveling use, a blend may be prepared by optional combination of direct distillation gasoline, cracking gasoline, reformed gasoline, alkylate gasoline, isomerized gasoline, polymer gasoline and the like, or distillation products thereof, at the time of the addition of the oxygen-containing organic compound. In this way, a fuel having suitable properties for use in a spark ignition engine can be prepared. Such a fuel has a research octane number of 90 or more, a Reid vapor pressure of from 0.6 to 0.9 kg/cm$^2$ and a density of from 0.700 to 0.783 g/cm$^3$ at 15° C., and has distillation characteristics similar to those of gasoline for spark ignition engine use.

The oxygen-containing organic compound contains an unsaturated bond such as a triple bond in its molecule. When a gasoline fuel containing this type of organic compound is used under such conditions that a decrease in oxidation stability is probable, the gasoline fuel may be supplemented with an antioxidant selected from, for example, amines, phenols, and hydroquinones. The antioxidant may be used in an approximate amount of from 10 to 100 ppm.

If necessary, the fuel oil composition may be further supplemented with known fuel oil additives which include, for example: metal deactivators such as thioamides; detergent-dispersants such as succinic acid imide, polyalkyl amine, polyether amine; deicing agents such as polyhydric alcohols, and ethers thereof; combustion improvers such as sulfuric acid esters of higher alcohols; antistatic agents such as anionic surface active agents, cationic surface active agents, ampholytic surface active agents; and coloring agents such as azo dyes. These fuel oil additive agents may be used alone or as a mixture of two or more. They may be used in optional amounts, but preferably in a total amount of 1,000 ppm or less.

By the use of the fuel oil composition of the present invention, flame propagation speed can be improved over a broad range of fuel/air ratios, thereby rendering possible optimization of the ignition timing of a spark ignition engine and improvement of the output power of the engine independently of its operation conditions, irrespective of driving conditions, irrespective of driving conditions.

Also, the fuel oil composition of the present invention can improve ignitability without adding metal components to the composition when a spark ignition engine is operated with a lean or rich fuel-air mixture, in addition to its ability to reduce cycle fluctuation caused by the variation in the formation of fuel-air mixture which occurs even during normal operation. In consequence, the fuel oil composition of the present invention, in which conventional gasoline is supplemented with the aforementioned oxygen-containing organic compounds, can provide stable combustion by reducing fluctuations of indicated mean effective pressure, maximum cylinder pressure and the like, independently of changes in the fuel/air ratio.

In addition, the fuel oil composition of the present invention has significant industrial value, because stable combustion leads to the improvement of exhaust gas characteristics, as well as to improvement of working conditions, such as startability and the like, of a spark ignition engine.

EXAMPLES

The following examples are provided to further illustrate the present invention. It is to be understood, however, that the examples are for purpose of illustration only and are not intended as a definition of the limits of the invention.

Example 1

In order to confirm the effect of the oxygen-containing organic compounds of the present invention on the improvement of flame propagation speed of a fuel-air mixture, a series of tests were carried out using a constant-volume combustion apparatus which has been designed for use in the evaluation of combustion characteristics of liquid fuel. The vessel of this apparatus, having an inner dimension of 60×40×208 mm and a content volume of 499 cc, is equipped with two observation windows made of Pyrex glass on opposite planes of the combustion chamber in addition to necessary means for stable formation of a fuel-air mixture and for heating, ignition and the like. Using this vessel and under atmospheric pressure and an elevated temperature (450° K.), the times required for the flame front to reach predetermined positions in the combustion chamber were measured by means of a He-Ne laser beam refraction method, and the flame propagation speed was calculated based on the relationship between travel distances of the flame front and the measured times.

A total of five fuel oil compositions were prepared by blending a commercial regular gasoline (which was also used in Examples 2 and 3) with the oxygen-containing organic compounds of the present invention, and their flame propagation speeds were measured in accordance with the above method. The measured flame propagation speeds were compared with that of the commercial regular gasoline in order to determine the effect of the compounds of the present invention, with the results shown in Table 1.

TABLE 1

| Oxygen-containing compound blended | Blending ratio (% by volume)*1 | Increase in flame propagation speed*2 (%) |
|---|---|---|
| Methylpropargyl ether | 20 | 23.6 |
| Acrolein | 20 | 22.4 |
| Furan | 25 | 17.5 |
| 3-Butyn-2-one | 10 | 7.4 |

TABLE 1-continued

| Oxygen-containing compound blended | Blending ratio (% by volume)*1 | Increase in flame propagation speed*2 (%) |
|---|---|---|
| Diallyl ether | 15 | 9.3 |

*1Commercial regular gasoline was used as the base gasoline.
*2Increase compared to the base gasoline.

Example 2

In order to show the effect of increased flame propagation speed on the output power improvement of a spark ignition engine, a single cylinder gasoline engine with a displacement of 403 cc (Type 530, available from AVL Co.) was modified in such a manner that combustion chamber pressure could be measured. In this case, a pressure transducer was mounted on the cylinder head. Using the thus modified gasoline engine, pressure in its combustion chamber was measured to carry out combustion analysis. FIG. 1 shows results of the measurement of indicated mean effective pressures when the gasoline engine was operated at an engine speed of 1,000 rpm with an ignition timing at MBT (minimum ignition spark advance which generates maximum torque). In this instance, a commercial regular gasoline and a fuel composition prepared by blending the commercial regular gasoline with 20% by volume of methylpropargyl ether were used, and equivalence ratio of the fuel-air mixture was changed. Properties of the samples are shown in Table 2. The term "indicated mean effective pressure" as used herein refers to a mean pressure value given to a unit area on the surface of a piston in one cycle, which is generally used for the evaluation of unit power and is calculated based on the area of a pressure-volume diagram in a cylinder of an internal combustion engine obtained after subtracting engine loss due to lower flame propagation speed, valve timing, thermal dissociation, heat loss and the like.

TABLE 2

| Sample | Octane number (research method) | Reid vapor pressure (kg/cm$^2$) | Density (g/cc at 15° C.) |
|---|---|---|---|
| Commercial regular gasoline | 91 | 0.750 | 0.725 |
| Inventive composition*1 | 92 | 0.720 | 0.751 |

*1A blend consisting of 80% by volume of commercial regular gasoline and 20% by volume of methylpropargyl ether.

Example 3

Figure 2:
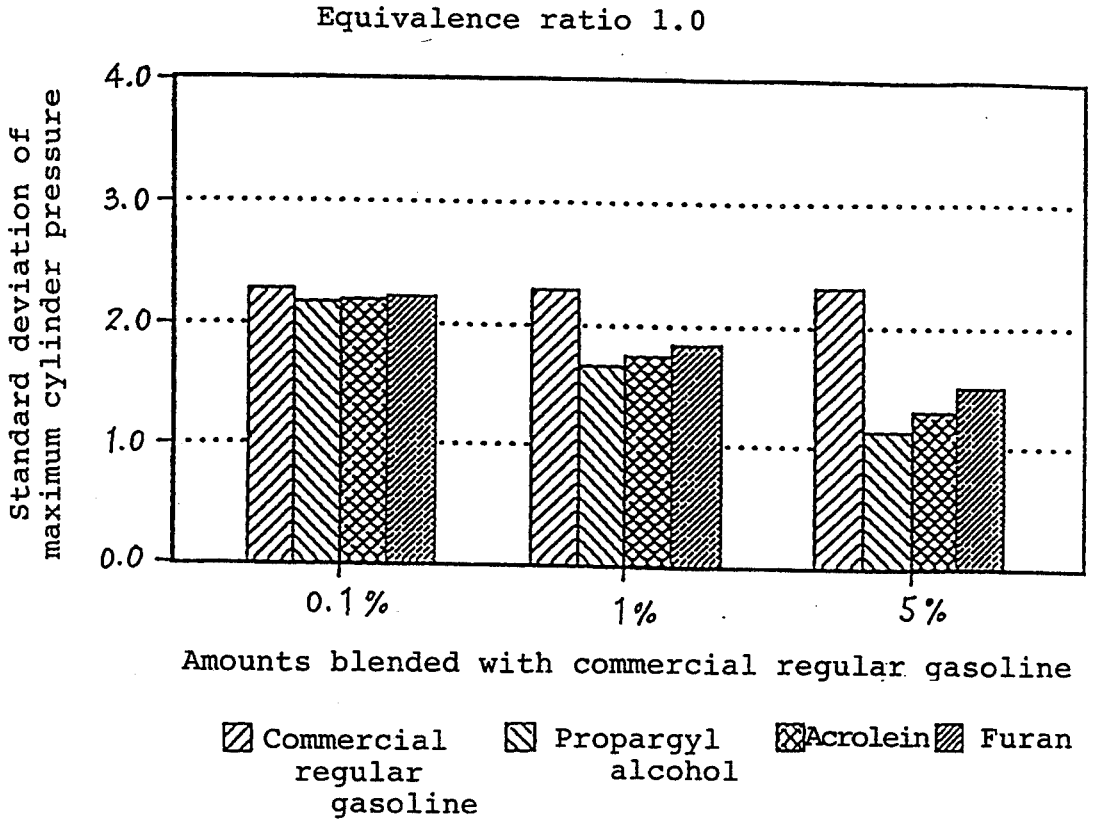
FIG. 2 is a graph showing standard deviation of cycle fluctuation of maximum cylinder pressure at an equivalence ratio of 1.0, with regard to a commercial regular gasoline and a gasoline preparation used in Example 3.
Figure 3:
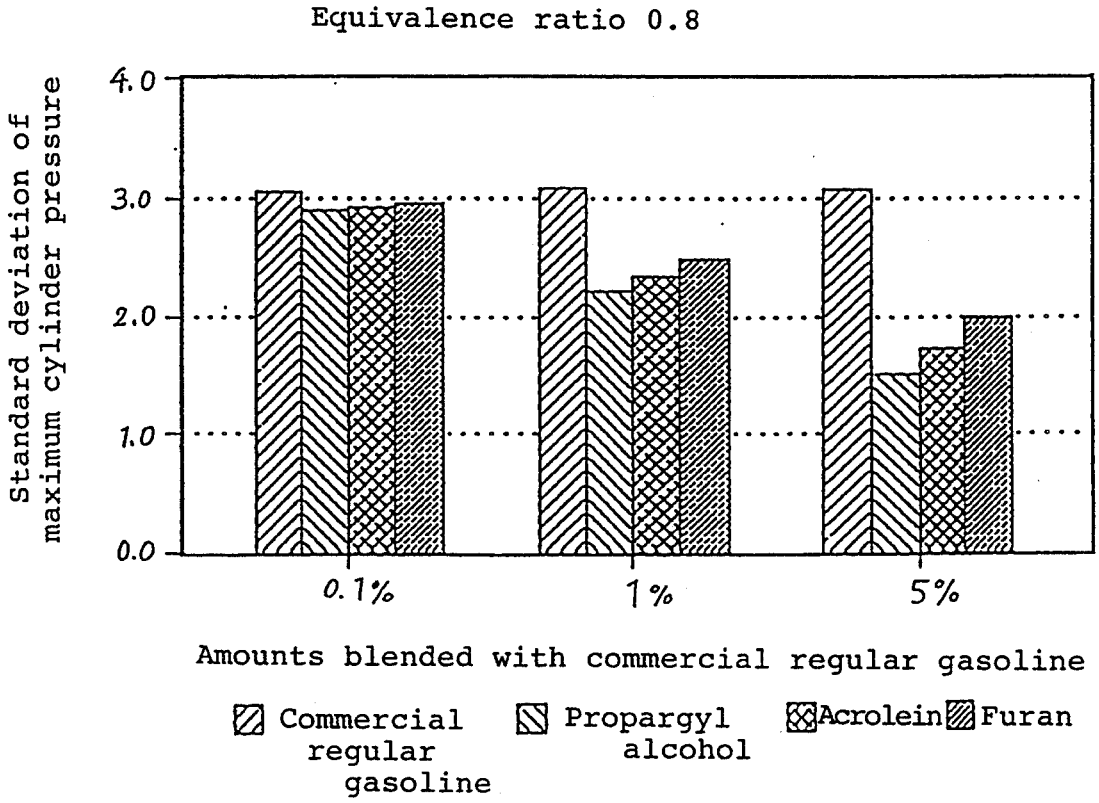
FIG. 3 is a graph showing standard deviation of cycle fluctuation of maximum cylinder pressure at an equivalence ratio of 0.8, with regard to a commercial regular gasoline and a gasoline preparation used in Example 3.
Figure 4:
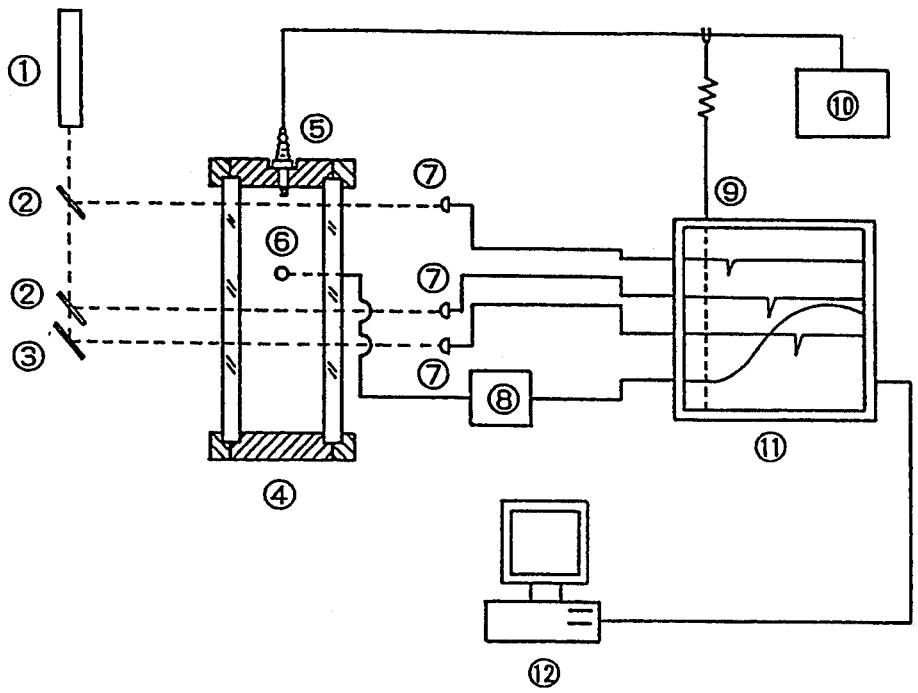
FIG. 4 is a whole view of a constant-volume combustion apparatus.
Figure 5:
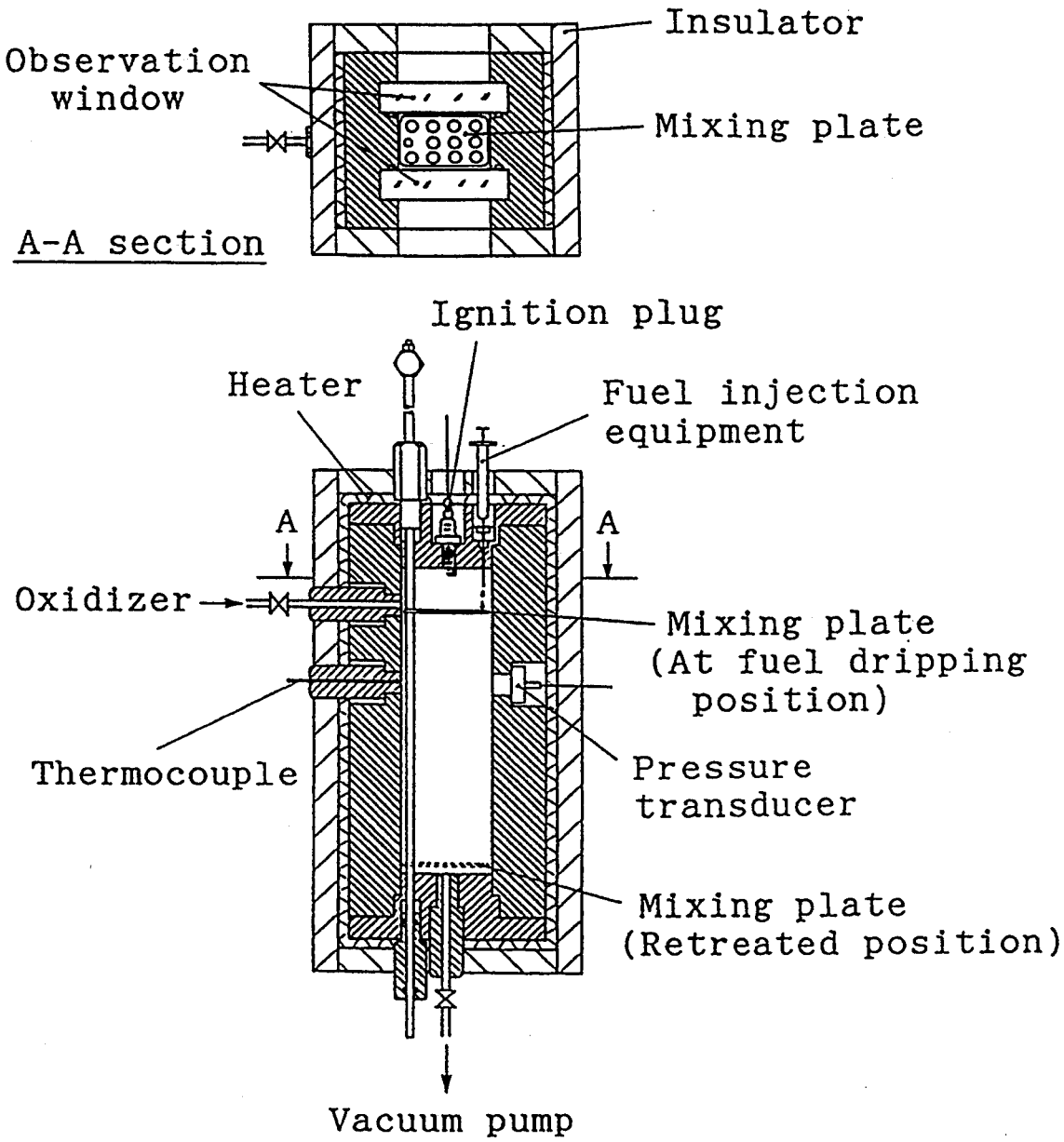
FIG. 5 is a partial enlarged view of a combustion vessel in a constant-volume combustion aparatus.

Using the engine and apparatus used in Example 2 and a total of four fuel samples, maximum cylinder pressures were measured under conditions of: engine speed, 1,000 rpm; ignition timing, MBT; and equivalence ratio (actual fuel-air ratio/theoretical fuel-air ratio), 1.0 or 0.8. Standard deviation of the results of 1,000 cycles was calculated for each of the fuel samples which included a commercial regular gasoline and three fuel oil compositions prepared by blending the commercial regular gasoline with the oxygen-containing organic compounds of the present invention. The results are shown in FIGS. 2 and 3. In this instance, since the oxygen-containing organic compounds were blended in small amounts, the properties (octane number, Reid vapor pressure, density) of the fuel oil compositions were almost the same as those of the commercial regular gasoline shown in Table 2. The term "maximum cylinder pressure" as used herein means a maximum pressure value reached during combustion of a fuel-air mixture in one cycle in a cylinder of an internal combustion engine.

In each case of the equivalence ratios of 1.0 and 0.8, the fuel oil compositions of the present invention showed smaller standard deviation of maximum cylinder pressure per cycle in comparison with the generally used commercial regular gasoline, thus confirming the effect of the fuel oil composition of the present invention in minimizing the cycle fluctuation of combustion conditions. As shown in FIG. 3, at a lean mixture side with an equivalence ratio of 0.8, the cycle fluctuation was improved to the level of the generally used commercial regular gasoline at an equivalence ratio of 1.0.

While the invention has been described in detail and with reference to specific embodiments thereof, it will be apparent to one skilled in the art that various changes and modifications can be made therein without departing from the spirit and scope thereof.

What is claimed is:

1. A fuel composition comprising gasoline and 3-butyn-2-one, wherein the 3-butyn-2-one is present in an amount of from 5 to 50% by volume based on the volume of the gasoline.

2. A fuel composition according to claim 1, wherein the 3-butyn-2-one is present in an amount of 10% by volume based on the volume of the gasoline.

* * * * *